United States Patent [19]

Bonerb

[11] Patent Number: 4,658,989

[45] Date of Patent: Apr. 21, 1987

[54] DISPOSABLE FLEXIBLE LINER FOR MATERIAL STORAGE AND HANDLING BAG, AND METHOD OF RELEASABLY INSTALLING THE SAME

[76] Inventor: Vincent C. Bonerb, All-Flow, Inc., 4409 S. Park Ave., Buffalo, N.Y. 14219

[21] Appl. No.: 752,776

[22] Filed: Jul. 8, 1985

[51] Int. Cl.[4] ..... B65D 90/04

[52] U.S. Cl. ..... 222/105; 53/175; 53/449; 220/85 B; 220/403; 222/185; 222/386.5; 383/109; 383/111; 383/112

[58] Field of Search ..... 222/1, 386.5, 94, 95, 222/183, 105, 107, 202, 203, 389, 460, 181, 206, 215, 173; 414/304, 323; 406/134; 383/109, 111, 112, 120; 220/400, 85 B, 402–404, 408–410, 449, 462, 470; 53/175, 449, 383–386

[56] References Cited

U.S. PATENT DOCUMENTS

| | | | |
|---|---|---|---|
| 1,692,986 | 11/1928 | Hardy et al. | 53/175 X |
| 2,609,854 | 9/1952 | Rosen | 383/111 X |
| 3,133,677 | 5/1964 | Bertels | 222/185 |
| 3,171,571 | 3/1965 | Daniels | 222/95 X |
| 3,459,357 | 8/1969 | Egger et al. | 53/449 X |
| 3,610,455 | 10/1971 | Greenhalgh et al. | 220/404 X |
| 3,961,655 | 6/1976 | Nattrass et al. | 222/181 X |
| 4,143,796 | 3/1979 | Williamson et al. | 222/185 |
| 4,256,150 | 3/1981 | Möckesch | 53/449 X |
| 4,347,948 | 9/1982 | Hamada et al. | 220/404 |
| 4,421,250 | 12/1983 | Bonerb et al. | 222/95 |
| 4,423,829 | 1/1984 | Katz | 222/105 X |
| 4,449,646 | 5/1984 | Bonerb et al. | 222/95 |
| 4,476,998 | 10/1984 | Bonerb et al. | 222/61 |
| 4,516,906 | 5/1985 | Krein | 220/462 X |
| 4,534,596 | 8/1985 | Bonerb | 298/27 |

FOREIGN PATENT DOCUMENTS

| | | | |
|---|---|---|---|
| 2146611 | 4/1985 | United Kingdom | 220/404 |

*Primary Examiner*—Joseph J. Rolla
*Assistant Examiner*—Kevin P. Shaver
*Attorney, Agent, or Firm*—Bernard, Rothwell & Brown

[57] ABSTRACT

A disposable, flexible, expandable lantern-shaped liner open at two ends is provided for use with a pneumatically-assisted, cup-shaped bag of the type used for transporting, storing and discharging diverse materials. The liner is equipped with pressure-sensitive adhesive spots for adherence and conformity to the shape of the bag upon inflation of the bag and liner. Liner are provided for detaching the liner from the bag for convenient disposal following discharge of material.

7 Claims, 7 Drawing Figures

DISPOSABLE FLEXIBLE LINER FOR MATERIAL STORAGE AND HANDLING BAG, AND METHOD OF RELEASABLY INSTALLING THE SAME

BACKGROUND OF THE INVENTION

1. Field of the Invention

This invention relates to improvements in disposable flexible liners for material handling and discharge bags as well as a method of releasably installing such a liner in a bag.

2. Prior Art

Material-handling and discharge bags of the dual-walled, pneumatically-assisted discharge type have been pioneered by All-Flow, Inc. of Buffalo, NY. Such bags are disclosed, for example, in U.S. Pat. Nos. 4,421,250, 4,449,646 and 4,476,998 and have been successfully installed and operated in both the stationary mode and transportation mode, e.g., in convertible trailers for converting such trailers from piece goods to bulk goods, see European Patent Application Publication No. 0121419 and corresponding U.S. Pat. No. 4,534,596.

Although the All-Flow bags for handling granular flexible material have in general a self-cleaning function accomplished by the flexing of the bag, there are times when it is desired to use the bags for very diverse materials on subsequent trips, e.g., fertilizer and edible grains for example. Also, certain materials are viscous and sticky, particularly certain liquids, and even though the bag is self-cleaning in granular materials, it would need washing out when handling sticky viscous materials such as molasses or the like. The cleaning of storage bags after a trip to remove sticky material for a subsequent trip is a very time-consuming manual operation and hence is quite expensive. Moreover, it is practically impossible to obtain sterile cleanliness even with steam-cleaning of storage bags.

Accordingly, there is an unfulfilled need in the art for a disposable liner for material-handling and storage bags which liner is of an inexpensive material so it could be disposed after each use, but could be quickly and easily installed and removed. This would eliminate the cleaning problem and would also eliminate a sanitation problem involving different loads of incompatible materials. Although there was a need for such in the art, Applicant is unaware of any attempts to fulfill such need. Various problems are faced such as having a liner which would conform to the walls of the material storage bag and stay there during installation and then be removable after discharge while at the same time being expandable and inexpensive enough to allow it to be disposed of after each use.

SUMMARY OF THE INVENTION

This invention provides a disposable flexible liner for a pneumatically-assisted, cup-shaped bag having an inverted frusto-conical connection from the top of the cup shape and a discharge opening near the center of the bag bottom. The liner is a lantern-shaped body of flexible, disposable material open at both ends and the body of the liner is expandable to conform to the inner wall of the cup-shaped bag, such expansion being accomplished by means of pleats or resilient expansible material in the body of the bag. The outer surface of the liner has means for releasably attaching it to the inner wall of the material handling and storage bag in the form of pressure-sensitive adhesive spots. The liner is installed by placing it in the bag with one open end through the top of the bag and the other end through the bottom of the bag, and the liner is inflated from the other end to cause it to conform to the inner wall of the bag and the pressure-sensitive adhesive spots will seal it to the bag. The pressure is then released and the bag with the liner can be filled with material. After discharge, the pressure-sensitive adhesive is removed from the wall by lines attached to the spots of the pressure-sensitive adhesive.

DETAILED DESCRIPTION OF THE PREFERRED EMBODIMENTS

Figure 1:
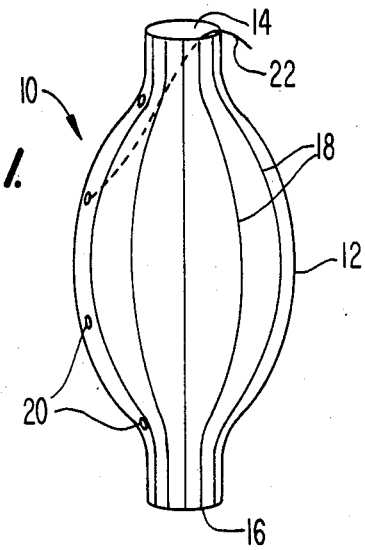
FIG. 1 is a perspective, somewhat schematic view of the disposable liner of this invention.

As shown in FIG. 1, a disposable flexible liner 10 is constructed having a generally lantern-shaped body 12 which bulges more in the center than at its ends and is open at both ends providing an open top 14 and open bottom 16. The disposable liner may be constructed of relatively inexpensive material such as can be economically disposed of after a single use. The body 12 of the liner is expandable, for example, by having a plurality of pleats 18 running longitudinally of the liner. An alternative means of providing the expansion of the body 12 is to have longitudinal portions of the body of resilient, stretchable material or the entire body constructed of resilient stretchable material.

Figure 2:
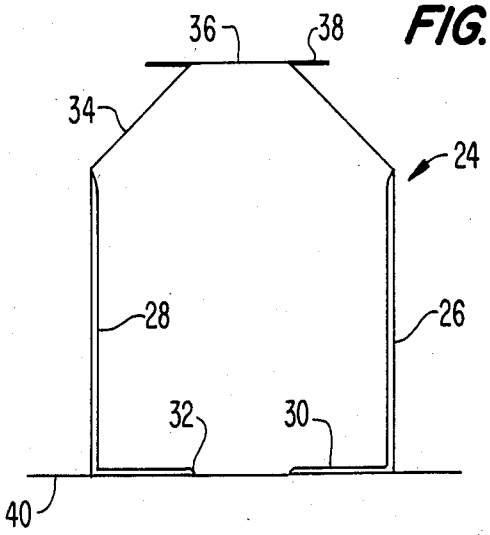
FIG. 2 is a sectional elevation view of a material handling and storage bag of this invention as installed.

Attached to the outer surface of the body are pressure-sensitive adhesive spots 20, not all spots being shown in FIG. 1, but there being sufficient spots to cause the liner to adhere to the inner wall of a material storage bag 24 as shown in FIG. 2. Lightweight lines of cord, twine or the like 22 (only two shown in FIG. 3C) are secured to the inner surface of the body at the place where the adhesive spots 20 are on the outer surface in order to pull and release the adhesive for removing the disposable liner.

FIG. 2 shows schematically one embodiment of a material handling and storage bag to which the disposable liner of this invention is especially applicable. This is the storage bag such as sold and licensed by All-Flow, Inc. of Buffalo, N.Y., and shown, for example, in the above referenced patents. The bag 24 has a dual-walled, cup-shaped portion 26 with an inner wall 28 and a bottom 30 having a discharge opening 32 generally adjacent the center of the bottom. An inverted frusto-conical connection 34 extends between the top of the cup-shaped portion 26 and a fill opening 36. The bag is shown in FIG. 2 in the environment of a structure having a top hatch 38 and a bottom support 40.

The use of the disposable, flexible liner of the invention and the method of installing it is illustrated in FIGS. 3A–E.

Figure 3A:
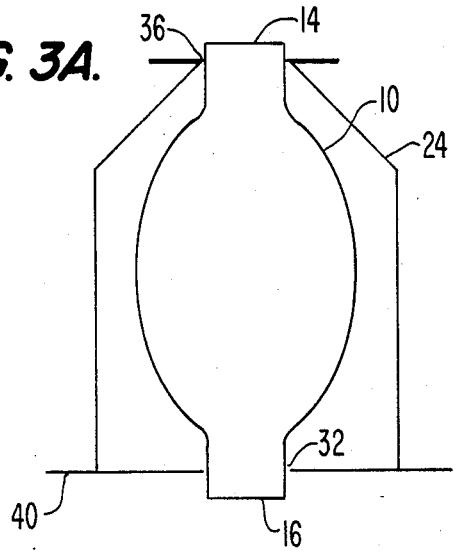
FIGS. 3A–E show steps of installing the disposable liner in the bag, filling and emptying the bag and removing the disposable liner.

As shown in FIG. 3A, the disposable, flexible liner 10 with open ends 14 and 16 is installed so that one end extends to the bottom opening 32 and the other to the fill opening 36 of the material handling bag 24.

Figure 3B:
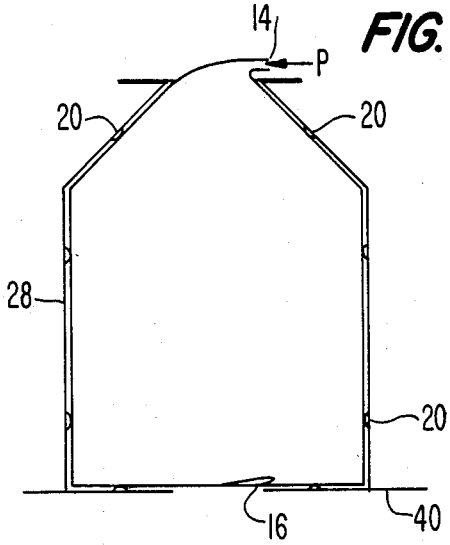

As shown in FIG. 3B, the bottom opening 16 is closed, the top opening 14 is snug down to a source of air under pressure P and the liner 10 is inflated so that its walls can expand by means of the pleats or other means 18 to conform to the inner wall 28 and frusto-conical portion 34 of bag 24. The air pressure causes the pressure-sensitive adhesive spots 20 to stick to the inner walls of the bag 24. The pressure P is then released and the opening 14 opened for filling the bag 24 with material to be handled.

Figure 3C:
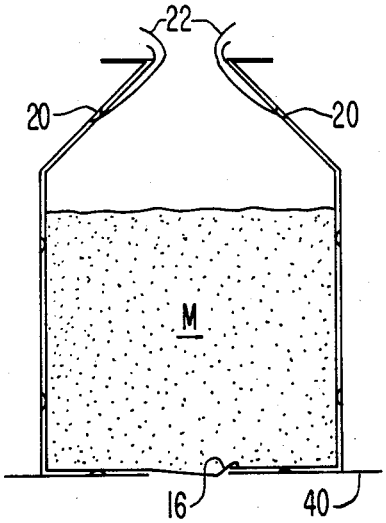

FIG. 3C shows the bag filled with material M to be handled, e.g., stored or transported and then discharged. As shown in FIG. 3C, the liner 10 is adhered through adhesive spots 20 to the walls of the bag 24 and lines 22 extend along the edges and out the opening so as to not be in the way. Of course, the top hatch 38 could be closed during storage or transportation and the other conventional features of the handling bags are not shown.

Figure 3D:
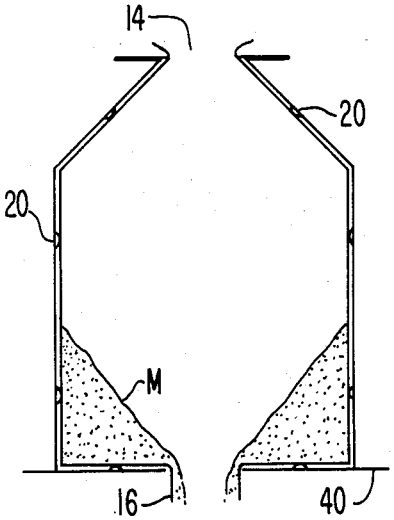

FIG. 3D shows the discharge of the material M in partial discharge through outlet opening 16. If the bag is an All-Flow-type bag, the inner wall 28 may be inflated to accomplish the final discharge as taught in the All-Flow patents. Such is not shown in the drawings, FIGS. 3A–E being simplified showings for the sake of illustration.

Figure 3E:
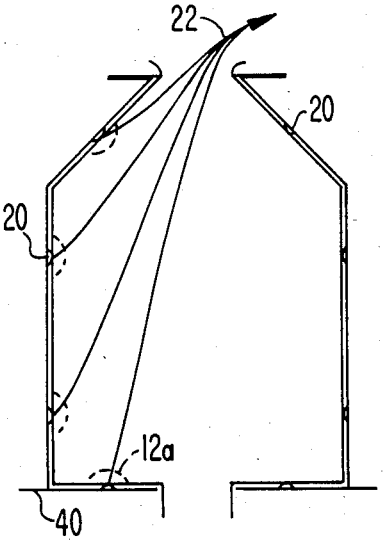

FIG. 3E shows the means of removing the disposable liner for disposing of the same after the complete discharge of material M. The lines 22, which are attached to the liner 10 at the area of each pressure-sensitive discharge spot 20, may be pulled either individually or simultaneously to cause the portion of the liner wall 12 to come loose as indicated at 12*a*. This allows the entire liner to be pulled upwardly and out the opening 36. Alternatively, the lines could extend through the bottom and the liner could be pulled out the discharge opening. All of the lines 22 are not shown in FIG. 3E for the sake of simplicity.

Although the disposable liner has been illustrated and finds a special applicability in the All-Flow bag as disclosed above, it is not limited to such, but could be used with any material handling and storage bag having inlet and discharge openings not too far from vertical alignment.

I claim:

1. A disposable, flexible liner for a material-handling bag, the bag including a cup-shaped portion and an inverted frusto-conical connection from the top of the cup shape to a filling opening, the bag having a discharge opening near the center of the bag bottom, the liner comprising: a lantern-shaped body of flexible, disposable material open at both ends, means allowing the lantern-shaped body to expand and conform to the inner wall of the material-handling bag, and releasable adhesive means on the outer surface of the lantern-shaped body for releasably attaching the outer surface of the lantern-shaped body to the inner wall of the material handling bag.

2. A liner as in claim 1 wherein the means allowing the lantern-shaped body to expand and conform to the inner wall of the cup-shaped bag comprises pleats in the surface of the lantern-shaped body, the pleats running longitudinally of the body.

3. A liner as in claim 1 wherein the means allowing the lantern-shaped body to expand and conform to the inner wall of the cup-shaped bag comprises elastic portions comprising at least portions of the lantern-shaped body.

4. A liner as in claim 1 wherein the releasable adhesive means for releasably attaching the outer surface of the lantern-shaped body to the inner wall of the cup-shaped bag comprises releasable adhesive spots on the outer surface of the lantern-shaped body.

5. A liner as in claim 4 further comprising flexible lines extending from the inner surface of the liner at the area of the releasable spots through one open end of the liner to allow the releasing of the releasable adhesive spots.

6. A method of installing a releasably-attachable disposable liner to the inside surface of the wall of a material-handling bag, the bag including a cup-shaped portion and an inverted frusto-conical connection from the top of the cup-shaped portion to a fill opening, the bag having a discharge opening near the center of the bag bottom, the method comprising: positioning an open-ended lantern-shaped expandable wall, disposable wall liner inside the bag with one open end in the fill opening and the other open end in the discharge opening, said liner having releasable adhesive on an outer surface of said liner, said method further comprising restricting air passage through one of the ends of the liner while pneumatically inflating the liner through the other end to cause the walls of the liner to generally conform to the inner walls of the bag and to pressure adhere the adhesive on the outer surface of the liner to the inner surface of the wall of the bag to thereby releasably adhere the liner to the bag wall, and filling the disposable-liner-lined bag with material.

7. A method as in claim 6 further comprising discharging the material from the bag and releasing the pressure-adhered outer surface of the liner from the inner surface of the bag, and disposing of the liner.

* * * * *